US012655506B2

(12) United States Patent
Huang et al.

(10) Patent No.: US 12,655,506 B2
(45) Date of Patent: Jun. 16, 2026

(54) NON-MAGNETIC STAINLESS STEEL WITH HIGH STRENGTH AND SUPERIOR CORROSION RESISTANCE AND PREPARATION METHOD THEREOF

(71) Applicant: THE UNIVERSITY OF HONG KONG, Hong Kong (CN)

(72) Inventors: Mingxin Huang, Hong Kong (CN); Kaiping Yu, Shenzhen (CN)

(73) Assignee: The University of Hong Kong, Hong Kong (CN)

( * ) Notice: Subject to any disclaimer, the term of this patent is extended or adjusted under 35 U.S.C. 154(b) by 645 days.

(21) Appl. No.: 18/001,894

(22) PCT Filed: Jun. 2, 2021

(86) PCT No.: PCT/CN2021/097817
§ 371 (c)(1),
(2) Date: Dec. 15, 2022

(87) PCT Pub. No.: WO2021/254143
PCT Pub. Date: Dec. 23, 2021

(65) Prior Publication Data

US 2023/0295786 A1 Sep. 21, 2023

(30) Foreign Application Priority Data

Jun. 19, 2020 (CN) ..... 202010563089.8

(51) Int. Cl.
*C22C 38/38* (2006.01)
*C21D 8/02* (2026.01)
(Continued)

(52) U.S. Cl.
CPC ..... *C22C 38/38* (2013.01); *C21D 8/02* (2013.01); *C21D 8/0236* (2013.01); *C21D 9/46* (2013.01);
(Continued)

(58) Field of Classification Search
None
See application file for complete search history.

(56) References Cited

U.S. PATENT DOCUMENTS 4,751,046 A 6/1988 Simoneau
5,501,834 A * 3/1996 Nakasuji ..... C22C 38/38 420/583

FOREIGN PATENT DOCUMENTS

CN 85 1 04938 A 1/1987
CN 106011681 A 10/2016
(Continued)

OTHER PUBLICATIONS

International Search Report dated Aug. 24, 2021 in International Application No. PCT/CN2021/097817.

*Primary Examiner* — Jenny R Wu
(74) *Attorney, Agent, or Firm* — SALIWANCHIK, LLOYD & EISENSCHENK

(57) ABSTRACT

The present invention provides a non-magnetic stainless steel with high strength and corrosion resistance and a preparation method thereof. The non-magnetic stainless steel composed of the following components according to percentage by weight: 17%<Cr<23%, 17%<Mn<23%, 17%<Co<23%, 0.5%<Si<3%, and the balance of iron and inevitable impurities thereof. The preparation method includes: (1) melting a raw material and casting it to a mold to obtain a stainless steel block; (2) homogenizing the stainless steel block at 1,100-1,250° C. for 6-12 hours; (3) forging the homogenized stainless steel block at 1,050-1,150° C. with a final forging temperature of 850-950° C. to obtain a plate having a thickness of 5-15 mm; and (4) holding the forged plate at 1,000-1,250° C. for 10-30 minutes and then put it in water for quenching. The non-magnetic stainless steel of the present invention has superior pitting corrosion resistance and mechanical properties. After
(Continued)

a certain heat treatment process, the stainless steel has ultrahigh strength, hardness and toughness and excellent corrosion resistance and low-temperature toughness, and can be used for preparing an outer cladding material of a superconductor in the nuclear fusion industry.

4 Claims, 8 Drawing Sheets

(51) Int. Cl.

| | |
|---|---|
| ***C21D 8/0221*** | (2026.01) |
| ***C21D 9/46*** | (2006.01) |
| ***C22C 33/04*** | (2006.01) |
| ***C22C 38/02*** | (2006.01) |
| ***C22C 38/30*** | (2006.01) |

(52) U.S. Cl.
CPC ..... *C22C 33/04* (2013.01); *C22C 38/02* (2013.01); *C22C 38/30* (2013.01)

(56) References Cited

FOREIGN PATENT DOCUMENTS

| | | |
|---|---|---|
| CN | 111074132 A | 4/2020 |
| EP | 1 087 029 A2 | 3/2001 |

* cited by examiner

NON-MAGNETIC STAINLESS STEEL WITH HIGH STRENGTH AND SUPERIOR CORROSION RESISTANCE AND PREPARATION METHOD THEREOF

CROSS-REFERENCE TO RELATED APPLICATIONS

This application is the U.S. national stage application of International Patent Application No. PCT/CN2021/097817, filed Jun. 2, 2021, which claims the benefit under 35 U.S.C. § 119 of Chinese Application No. 202010563089.8, filed Jun. 19, 2020, the disclosures of each of which are incorporated herein by reference in their entirety.

TECHNICAL FIELD

The present invention belongs to the field of stainless steel, and particularly relates to a non-magnetic stainless steel with excellent mechanical properties and superior corrosion resistance and a preparation method thereof.

BACKGROUND ART

Stainless steel generally refers to a kind of steel resistant to air, saline water, weak acid and alkali, and other corrosive media. Due to its great mechanical properties and excellent corrosion resistance, the stainless steel has been widely used in home decoration, food, electronics, medical treatment, and other industries. According to phase compositions, the stainless steel can be generally divided into four types: austenitic stainless steel, martensitic stainless steel, ferritic stainless steel, and austenite-ferrite duplex stainless steel.

As for the austenitic stainless steel, by adding austenitic stabilization elements, such as Ni, Co, and Mn, the stainless steel is allowed to form a face-centered cubic structure which is non-magnetic. The austenitic stainless steel also has great plasticity, and is easily processed into products in various shapes. As a derivative of the austenitic stainless steel with excellent corrosion resistance, 316L stainless steel has been widely used in the chemical industry. 316LN stainless steel is developed by adding a certain amount of the element N based on the 316L stainless steel. Due to its excellent corrosion resistance, non-magnetic properties and higher strength than the 316L stainless steel, the 316LN stainless steel has become a wall material most commonly used for a Tokamaktoroidal device at present.

A brief description of the Tokamak device is given below. As the most promising clean energy source for humans, nuclear energy is generally derived from two sources: fission of heavy elements and fusion of hydrogen. A fission technology for the heavy elements, such as uranium, has been applied in practice. A fusion technology for the light elements, such as protium and deuterium, has also been developed actively. At present, an EAST (Experimental Advanced Superconducting Tokamak) device is mainly used to realize the conversion of nuclear fusion energy. The Tokamak device is a toroidal device that creates a vacuum suspension environment for the fusion of deuterium ortritium by constraining the drive of electromagnetic waves.

However, the 316LN stainless steel has some problems in composition control and mechanical properties. On the one hand, since the content and distribution of N are difficult to control in the process of preparing the 316LN stainless steel, the 316LN stainless steel is likely to undergo local intergranular corrosion and pitting corrosion, and the mechanical properties of the 316LN stainless steel are degraded (with reference to Chinese patent CN10429171A). On the other hand, although the mechanical properties of the steel can be greatly improved by solid solution of a large number of N atoms, the N atoms have low solution solubility in molten iron under atmospheric or low pressure thermodynamically. As a result, the 316LN stainless steel has an upper strength limit of only 240-400 Mpa, and requirements of cladding materials for pressure resistance are still difficult to meet (with reference to Chinese patents CN106011681A and CN10330718A).

With the gradual maturity of the nuclear fusion technology and the industrialization of the Tokamak device, the wall material is required to have higher service temperature and pressure and stronger resistance to neutron irradiation and chemical corrosion.

SUMMARY OF THE INVENTION

An objective of the present invention is to provide a high-alloy austenitic stainless steel with superior pitting corrosion resistance and mechanical properties. After a certain heat treatment process, the stainless steel has ultra-high strength, hardness and toughness and excellent corrosion resistance and low-temperature toughness, and can be used for preparing an outer cladding material of a superconductor in the nuclear fusion industry.

In order to achieve the above objective, the present invention provides a non-magnetic stainless steel being composed of the following components according to percentage by weight: 17%<Cr<23%, 17%<Mn<23%, 17%<Co<23%, 0.5%<Si<3%, and the balance of iron and inevitable impurities.

Preferably, the non-magnetic stainless steel is composed of the following components according to percentage by weight: 19%<Cr<21%, 17%<Mn<19%, 19%<Co<21%, 1%<Si<2%, and the balance of the iron and inevitable impurities.

After a lot of in-depth studies, main elements in composition design of the present invention are controlled by the inventor as follows.

(a) Control of the Cr content: Cr is the most important component of the stainless steel, since a nano-sized oxide film formed by the element Cr which renders the stainless steel with corrosion resistance. In general, Cr in the stainless steel should have a mass fraction of greater than 13% so as to ensure good corrosion resistance. Cr can also be used for improving the high-temperature oxidation resistance of the steel. For example, Cr reacts with Fe to form spinel with a dense structure at above 1,000° C., which covers the surface of the steel to inhibit the substrate from being further oxidized. However, when the content of Cr in the steel is further increased, although the corrosion resistance of the steel can be further improved, a δ-Fe phase region may be expanded, so that the mechanical properties of the stainless steel are reduced, and magnetic properties are created.

(b) Control of the Co content: Co is an austenite forming element, which has an ability of stabilizing the austenite phase as equivalent to Ni. The shape, size, and position of the γ phase in the steel can be changed by adding different contents of Co. When the content of Co in the steel is increased, the A4 point temperature of the stainless steel can be increased, so that a high-temperature γ phase region is expanded, and the formation of δ ferrite is inhibited. Meanwhile, Co is also used as a main component of hard metals and superalloys, which can improve the strength, wear resistance, and high-temperature creep resistance of the steel.

(c) Control of the Mn content: Mn can be used for improving the strength and hardness of the steel, and affecting the stacking fault energy of the steel. The plastic deformation mechanism, twinning-induced plasticity (TWIP), and transformation-induced plasticity (TRIP) of the steel can be adjusted by changing the content of Mn. Therefore, the strength, hardness, and plasticity of the steel can be improved at the same time by adding an appropriate amount of Mn. Mn is also an austenite forming element, and can form an infinite solid solution with γ-Fe. Due to Mn, the A3 point temperature can be reduced while the A4 point temperature is increased, so that a γ phase region is expanded. In particular, when the Mn content is high enough, the γ phase region can be decreased to room temperature, and a single-phase austenitic structure can be obtained. However, when the content of Mn is too high, the corrosion resistance and machinability of the steel are reduced.

(d) Control of the Si content: Si has been widely used in spring steel, which can significantly improve the elastic limit, yield point, and tensile strength of the steel. In general, the strength of the steel can be improved by 15-20% by adding 1.0-1.2% of Si to the steel. Si can also form an ultra-thin oxide ($SiO_2$) on the surface of the steel to achieve a great protection effect on the steel, so that the low-temperature acid resistance and high-temperature oxidation resistance of the steel are improved.

According to the non-magnetic stainless steel provided in the present invention, the non-magnetic stainless steel has a yield strength of 500-600 Mpa, a tensile strength of 1,000-1,100 Mpa, and a ductility of 55-65%.

According to the non-magnetic stainless steel provided in the present invention, the non-magnetic stainless steel has a pitting potential of 900-1,050 mV.

The present invention further provides a method for preparing a non-magnetic stainless steel comprising the following steps:

(1) melting a raw material and casting it to a mold to obtain a stainless steel block, where the raw material is composed of the following components according to percentage by weight: 17%<Cr<23%, 17%<Mn<23%, 17%<Co<23%, 0.5%<Si<3%, and the balance of iron and inevitable impurities;

(2) homogenizing the stainless steel block at 1,100-1,250° C. for 6-12 hours;

(3) forging the homogenized stainless steel block at 1,050-1,150° C. with a final forging temperature of 850-950° C. to obtain a plate having a thickness of 5-15 mm; and (4) holding the forged plate at 1,000-1,250° C. for 10-30 minutes and then put it in water for quenching to obtain the non-magnetic stainless steel.

According to the preparation method provided in the present invention, the raw material is composed of the following components according to percentage by weight: 19%<Cr<21%, 17%<Mn<19%, 19%<Co<21%, 1%<Si<2%, and the balance of the iron and inevitable impurities.

According to the preparation method provided in the present invention, the step (1) includes putting the raw material in a vacuum induction melting furnace for melting.

According to the preparation method provided in the present invention, the step (2) includes putting the stainless steel block in a vacuum furnace for homogenization.

According to the preparation method provided in the present invention, the non-magnetic stainless steel after the treatment in step (4) has an all-austenitic structure, and has a yield strength of 500-600 Mpa, a tensile strength of 1,000-1,100 Mpa, a ductility of 55-65%, and a pitting potential of 900-1,050 mV.

According to the present invention, based on the positive influence of various elements on the steel, a passivation effect of Cr is initially used to achieve corrosion resistance of an alloy first, and then appropriate amounts of Mn and Co are added to form a stable austenite phase region in a medium and high temperature region, so that the formation of a δ-Fe phase in a high temperature region due to a large amount of Cr is inhibited, and the martensite start temperature (Ms) of the stainless steel is reduced to room temperature. The Ms point temperature can be roughly calculated by using the following empirical formula:

$$Ms(K)=764.2-302.6\times[C]-30.6\times[Mn]-8.9\times[Cr]+8.58\times[Co]-14.5\times[Si].$$

It is ensured that a stable austenite with a single structure (a non-magnetic structure) can be formed after quenching at room temperature in the present invention. The toughness and corrosion resistance of the material is further improved by using Si. The strength of the material is improved by using various elements with different atomic radii based on a solid solution strengthening effect. Through the above combination, a non-magnetic stainless steel with high strength and superior corrosion resistance is finally formed.

Based on the above, the present invention provides a non-magnetic stainless steel with high strength and superior corrosion resistance. In addition, after a large number of deformations, the stainless steel can still maintain superior corrosion resistance, so that the weakening of corrosion performance while increasing strength and radiation resistance through cold working can be avoided in the present invention.

BRIEF DESCRIPTION OF THE DRAWINGS

The embodiments of the present invention are described in detail below with reference to accompanying drawings, in which.

DETAILED DESCRIPTION OF THE INVENTION

Figure 1:
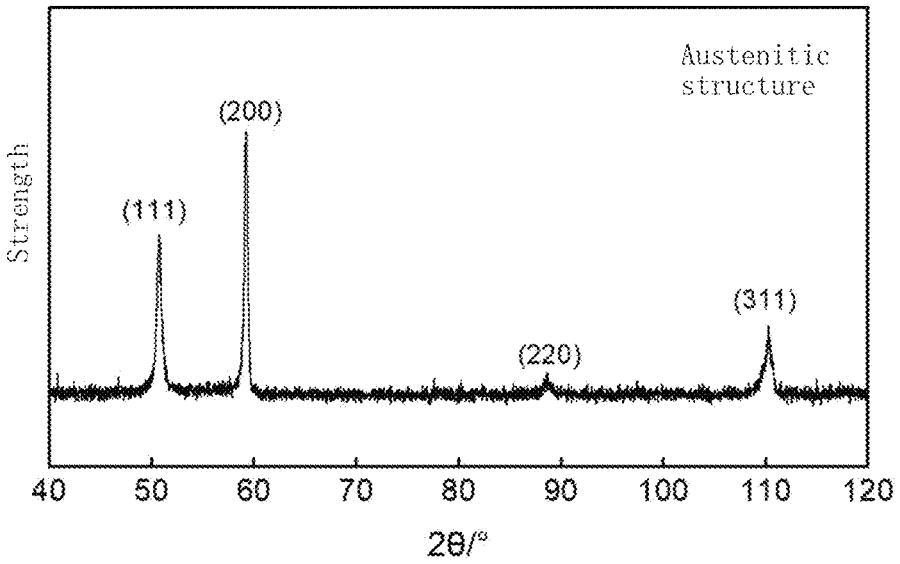
FIG. 1 is an XRD diagram of a non-magnetic stainless steel prepared in Example 1 of the present invention.

The present invention is further described below with reference to embodiments. The embodiments are intended only for explanations, and should not be construed to limit the scope of the present invention in any manner.

Example 1

In this example, a non-magnetic stainless steel and a preparation method thereof in the present invention are exemplarily illustrated.

(1) A raw material is put in a vacuum induction melting furnace for melting, and subjected to casting to a mold to obtain a stainless steel block, where the raw material having the following composition according to percentage by weight: 20.73% of Cr, 17.7% of Mn, 20.2% of Co, 1.7% of Si, and the balance of iron and inevitable impurities.

(2) After the molding, the stainless steel block is put in a vacuum heat treatment furnace for heat preservation at 1,200° C. for 7 hours to allow thorough homogenization of alloy elements.

(3) After the homogenization, the block is subjected to high-temperature forging at an initial forging temperature of about 1,150° C. and a final forging temperature of about 900° C. to obtain a plate with a thickness of about 10 mm and a geometrical size of 200 mm×100 mm×10 mm.

(4) After the forging, the plate is subjected to heat preservation at 1,200° C. for 20 minutes, and then put in water for quenching to obtain a non-magnetic stainless steel of the present invention.

Performance Characterization

Preparation of a material generally includes the following processes: melting of a raw material, casting to a mold, high-temperature homogenization, forging, heat treatment (that is, a sample before rolling), and rolling (the rolling capacity is 50% of a thickness of the raw material). The non-magnetic stainless steel in Example 1 is sampled after heat treatment and after rolling separately to carry out tests on mechanical properties and corrosion resistance. According to the corrosion resistance tested after the rolling, it is indicated that the material still has great corrosion resistance after a large number of deformations (dislocations) are introduced.

The corrosion resistance of the material is measured by using a three-electrode method. The stainless steel is used as a working electrode, a saturated calomel electrode is used as a reference electrode, a platinum sheet electrode is used as an auxiliary electrode, and a 3.5 wt. % of NaCl olution is used as a corrosive medium. The test is carried out at room temperature at a sample test area of 1 cm2 and a scanning rate of 3 mV/s. Specific operations are as follows. The non-magnetic stainless steel of the present invention is machined into a sample with a size of 10 mm×10 mm×3 mm. Each surface of the sample is preliminarily polished with P360 abrasive paper and P600 abrasive paper. The polished sample is passivated in 30% of nitric acid for 1 hour. A 10 mm×10 mm surface of the sample is connected to a copper wire. After ensuring its conductivity, the sample is encapsulated and cured with epoxy resin. The other 10 mm×10 mm surface of the sample is polished with P360 abrasive paper, P600 abrasive paper, P1000 abrasive paper, P1500 abrasive paper, P2000 abrasive paper, and P4000 abrasive paper in sequence to obtain a mirror surface. After being washed with acetone and ethanol and dried, the polished sample is subjected to an electrochemical corrosion test.

Analysis of the Results

FIG. 1 is an XRD diagram of a non-magnetic stainless steel prepared in Example 1. According to FIG. 1, it is shown that after the heat treatment process provided in the present invention, the stainless steel having the compositions of the present invention has an all-austenitic single-phase structure.

Figure 2:
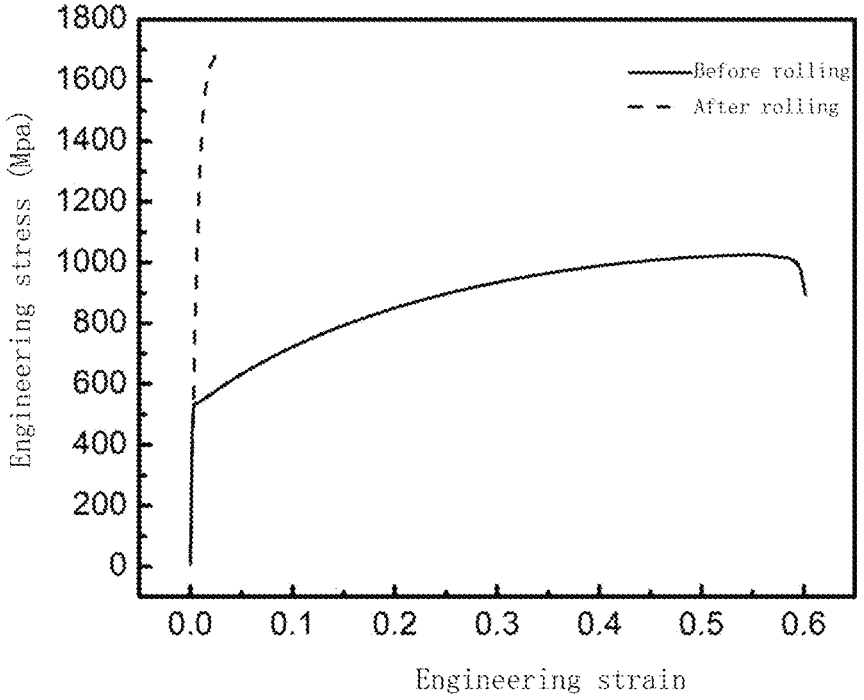
FIG. 2 is a diagram showing comparison of results of the engineering stress-engineering strain of the stainless steel block before rolling and the stainless steel plate after rolling in Example 1 of the present invention.
Figure 3:
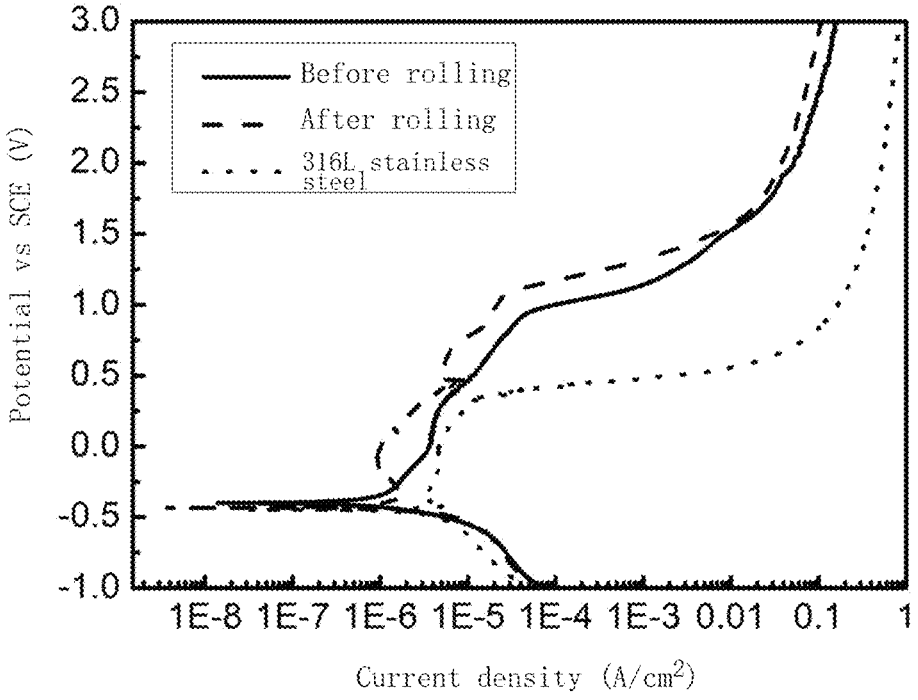
FIG. 3 is a diagram showing comparison of results of a corrosion test of the stainless steel block before rolling and the stainless steel plate after rolling in Example 1 of the present invention, and a 316L stainless steel.
Figure 4:
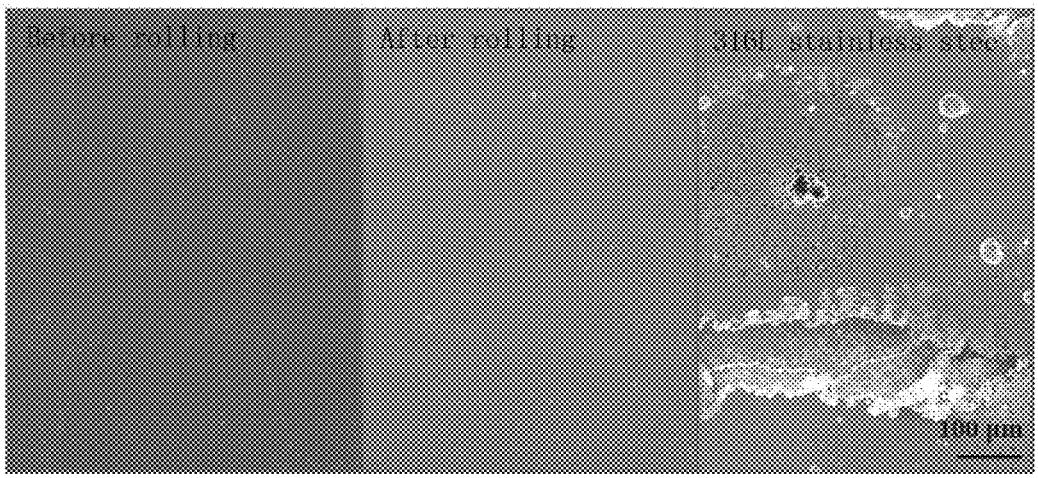
FIG. 4 shows comparison of the surface morphology of the stainless steel block before rolling and the stainless steel plate after rolling in Example 1 of the present invention, and a 316L stainless steel after a corrosion test.
Figure 5:
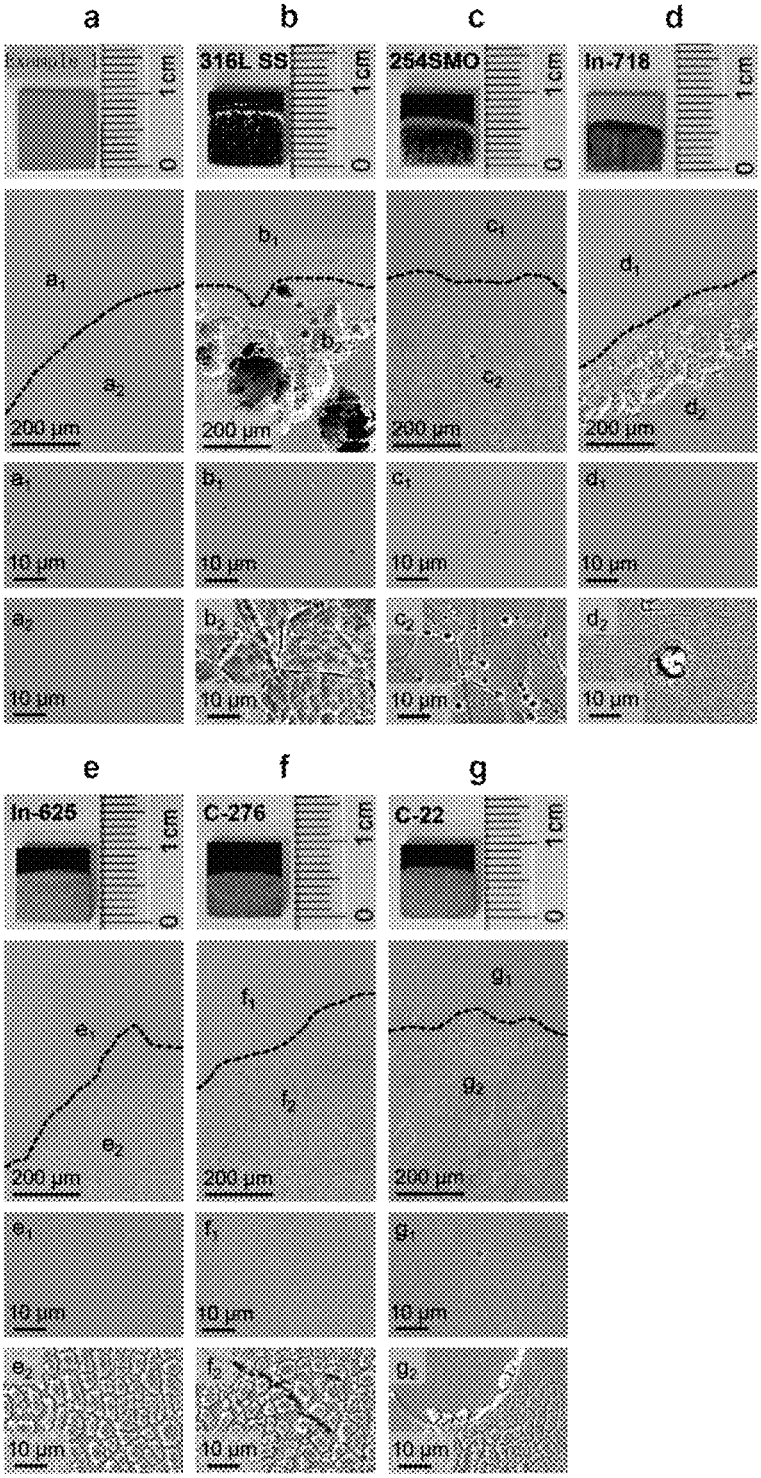
FIGS. 5A-5G are diagrams showing comparison of the stainless steel block in Example 1 of the present invention and a selected superalloy after corrosion at constant potential.
Figure 5A:
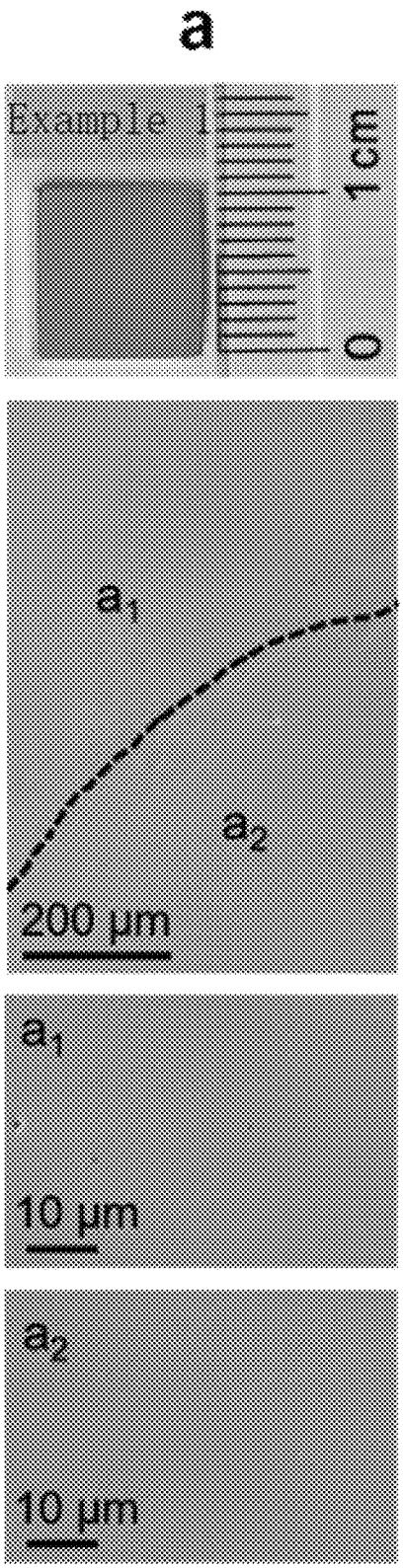
Figure 5B:
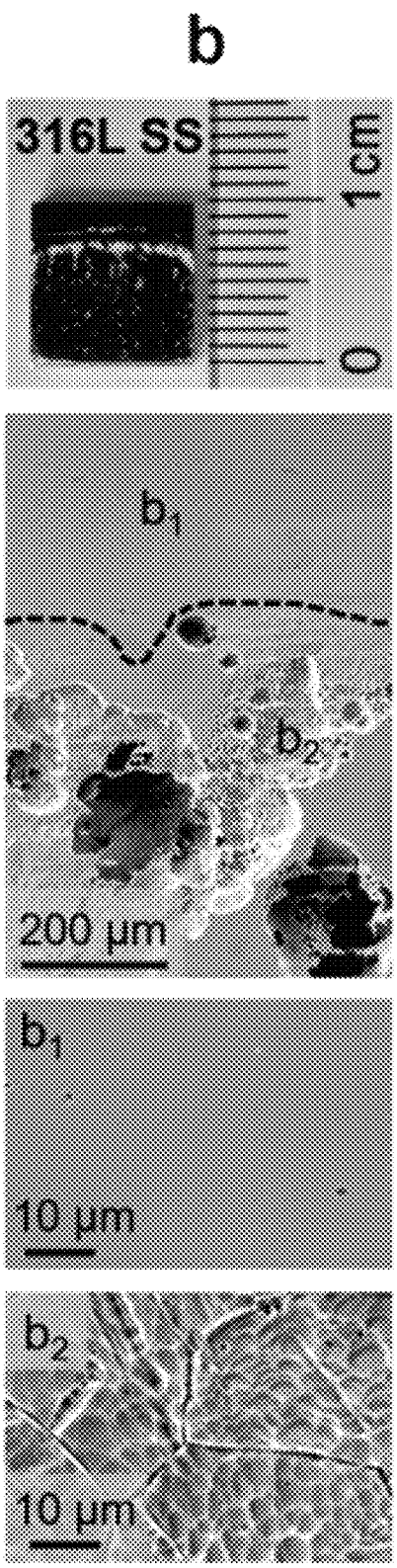
Figure 5C:
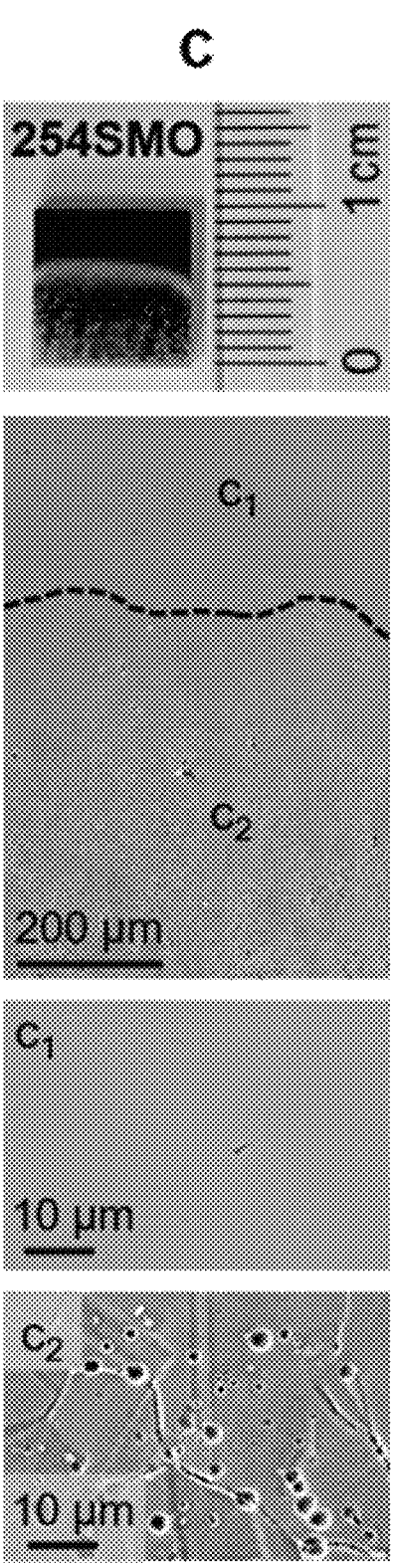
Figure 5D:
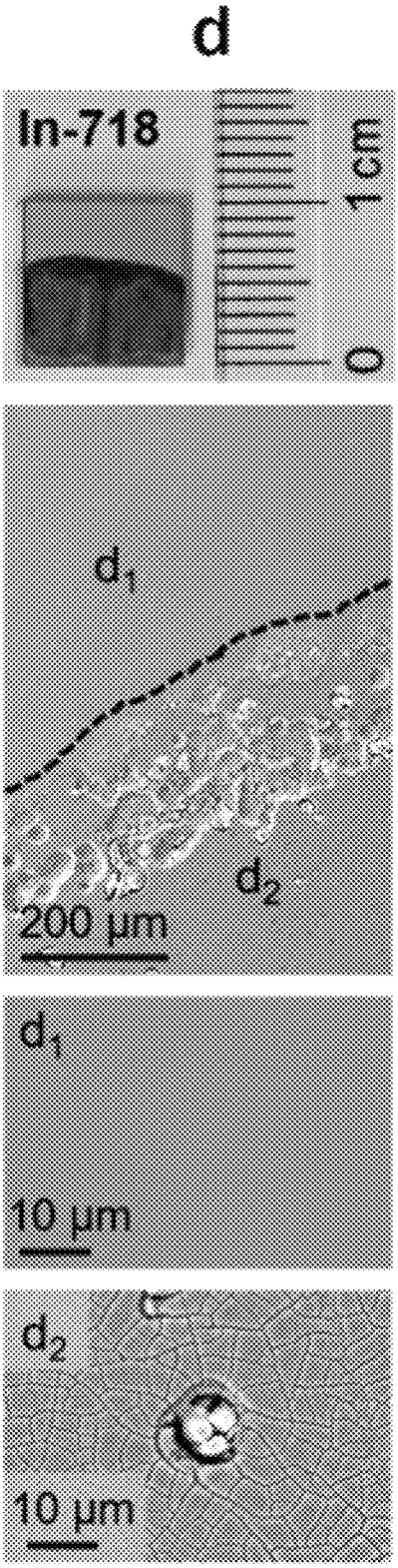
Figure 5E:
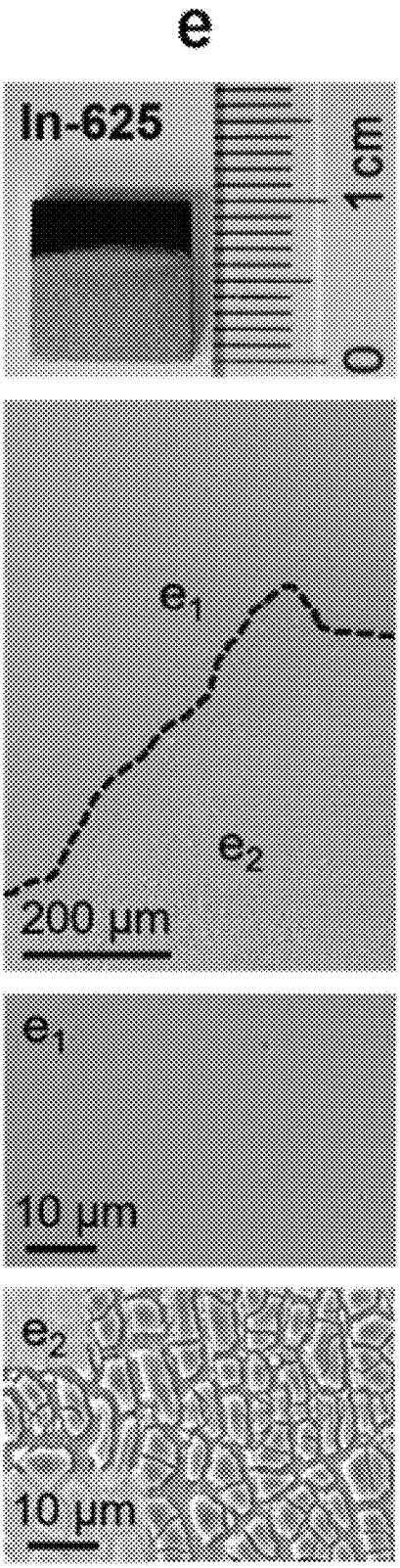
Figure 5F:
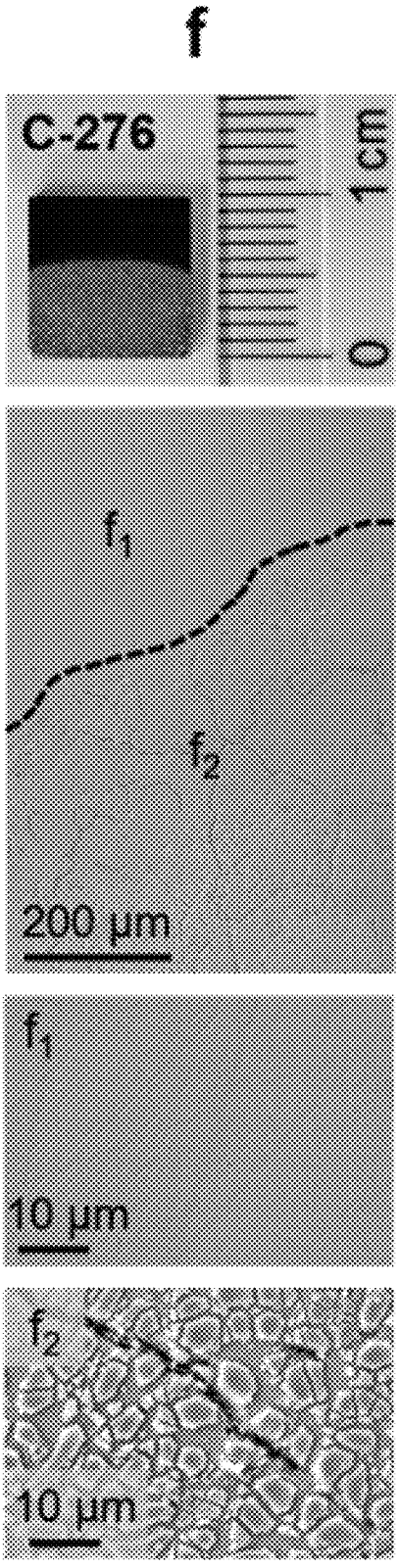
Figure 5G:
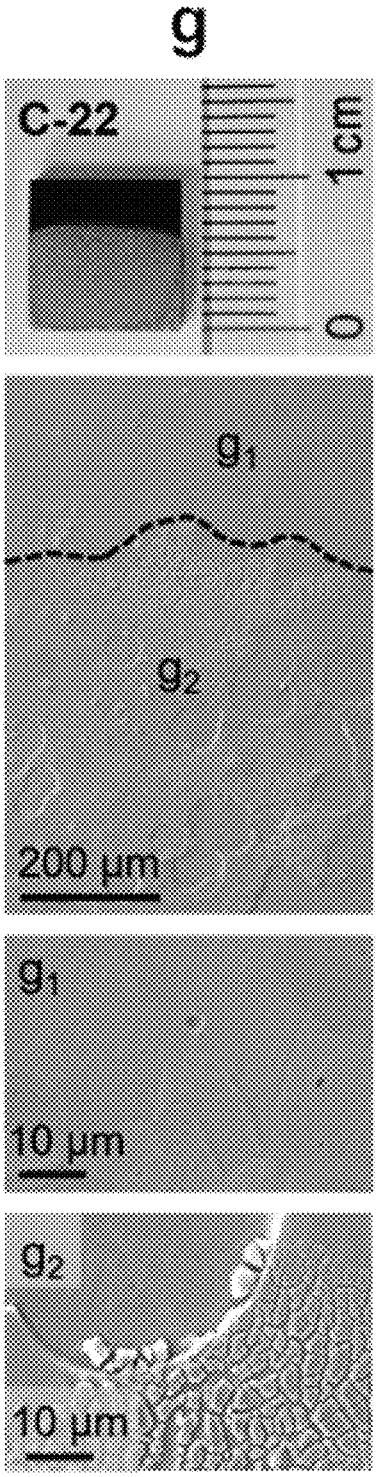

FIG. 2 is a diagram showing comparison of results of the engineering stress-engineering strain of a stainless steel block before rolling and a stainless steel plate after rolling in Example 1 of the present invention. FIG. 3 is a diagram showing comparison of results of a corrosion test of a stainless steel block before rolling and a stainless steel plate after rolling in Example 1 of the present invention, and 316L stainless steel. FIG. 4 shows comparison of the surface morphology of a stainless steel block before rolling and a stainless steel plate after rolling in Example 1 of the present invention, and 316L stainless steel after a corrosion test.

The stainless steel of Example 1 has excellent mechanical properties. As shown in FIG. 2, the yield strength and the tensile strength are 533 Mpa and 1,022 Mpa, respectively, both of which are greater than twice those of commercial 316L stainless steel. Moreover, at such high strength, the ductility of the stainless steel of the example is not reduced and can reach 60%, which is equal to or slightly better than that of the commercial 316L stainless steel. From FIG. 3, it can be known that the corrosion potential and the corrosion current are equivalent to those of the commercial 316L stainless steel. This is because both of the stainless steels are alloys with Fe as a substrate and have similar standard electrode potentials. Although experiments show that the polarization current of the stainless steel of Example 1 is suddenly increased at a potential of about 1,021 mV, this current change is not induced by pitting corrosion of the surface of the stainless steel, but is induced by an oxygen evolution reaction. Thus, it can be inferred that the pitting potential of the stainless steel of Example 1 is greater than 1,021 mV, which is much greater than that of the 316L stainless steel (330 mV). This phenomenon indicates that an oxide film different from that on the 316L stainless steel is formed on the surface of the stainless steel of Example 1, and it plays a stronger role in protecting the material from Cl-ions.

From FIG. 2, it can be seen that after rolling (the rolling capacity is 50% of a thickness of the raw material), the stainless steel in the example has a yield strength of 1,700 Mpa, but the corrosion resistance is equivalent to that of the sample before rolling, as shown in FIG. 3. The corrosion potential of the sample after rolling in the example and the corrosion potential of the sample without rolling are basically equivalent, being −420 mV and −400 mV, respectively. However, the pitting potential of the sample after rolling is slightly higher than that of the sample before rolling, indicating that the grain refinement and the introduction of a large number of dislocations have little influence on the corrosion resistance of the sample of the example. Moreover, whether rolled or not, the pitting corrosion resistance of the sample of the example is still far superior to that of the commercial 316L stainless steel. As shown in FIG. 4, when the test potential is up to 3,000 mV, pitting corrosion does not occur on the surface of the sample before and after rolling in the example. However, the surface of the commercial 316L stainless steel is seriously corroded.

The superior corrosion resistance of the non-magnetic stainless steel is further tested by polarization at constant potential of 1,500 mV for 10 minutes in comparisons with some representative superalloys, such as 254SMO super stainless steel, Inconel 718 (In-718), Inconel 625 (In-625), C-276, and C-22 nickel-based superalloy. The experimental results not only verifies that the stainless steel of Example 1 does not undergo pitting corrosion at 1021 mV (kinetic potential scan), but it is further found that it also did not undergo overpassivation corrosion. Under conventional test conditions, pitting corrosion does not occur on all of the comparative superalloys. However, when the potential is too high, overpassivation corrosion results due to further oxidation of $Cr^{3+}$ in the passivation film to soluble $Cr^{6+}$. Therefore, as shown in FIGS. 5A-5G, all comparative superalloys corrode to varying degrees under high potential conditions 1500 mV, while the test surface of the sample of Example 1 is remained intact.

The foregoing descriptions are merely preferred embodiments of the present invention, which are not intended to limit the present invention. Any modification, equivalent substitution and improvement made within the spirit and principle of the present invention shall fall within the protection scope of the present invention.

The invention claimed is:

1. A non-magnetic austenitic stainless steel having comprising, by weight:

from 17% to 23% chromium; from 17% to 23% manganese; from 17% to 23% cobalt; from 0.5% to 3% silicon; and a balance of iron and its inevitable impurities; wherein the stainless steel comprises an all-austenitic single-phase microstructure and wherein the non-magnetic stainless steel exhibits a pitting potential ranging from 900 mV to 1050 mV; a yield strength ranging from 500 MPa to 600 MPa; a tensile strength ranging from 1000 MPa to 1100 MPa; elongation ranging from 55% to 65%.

2. The non-magnetic stainless steel of claim 1, wherein the composition comprises, by weight percentage: from 19% to 21% chromium; from 17% to 19% manganese; from 19% to 21% cobalt; and from 1% to 2% silicon.

3. A non-magnetic austenitic stainless steel having an all-austenitic microstructure, comprising, by weight:

20.73% chromium (Cr); 17.7% manganese (Mn); 20.2% cobalt (Co); 1.7% silicon (Si); and a balance of iron and its inevitable impurities;

wherein the stainless steel comprises an all-austenitic single-phase microstructure, and wherein the non-magnetic stainless steel exhibits a pitting potential ranging from 900 mV to 1050 mV; a yield strength of approximately 533 MPa; a tensile strength of approximately 1,022 MPa; a ductility of approximately 60%.

4. The non-magnetic austenitic stainless steel of claim 3, wherein the non-magnetic stainless steel exhibits a pitting potential greater than 1,021 mV and up to 1050 mV.

* * * * *